United States Patent [19]

Yashima et al.

[11] 4,072,925

[45] Feb. 7, 1978

[54] WARNING SYSTEM FOR VEHICLES

[75] Inventors: Michio Yashima, Kawagoe; Takaya Senzaki, Iruma; Norimitsu Kurihara, Wako, all of Japan

[73] Assignee: Honda Giken Kogyo Kabushiki Kaisha, Japan

[21] Appl. No.: 642,136

[22] Filed: Dec. 18, 1975

[30] Foreign Application Priority Data

Dec. 23, 1974 Japan ..... 49-147877

[51] Int. Cl.[2] ..... G08B 19/00

[52] U.S. Cl. ..... 340/52 F; 340/27 R; 340/414

[58] Field of Search ..... 340/52 B, 52 D, 52 F, 340/27 R, 27 SS, 27 AT, 412, 414; 307/10 R

[56] References Cited

U.S. PATENT DOCUMENTS

| | | | |
|---|---|---|---|
| 3,541,550 | 5/1967 | Hamre | 340/52 F |
| 3,798,596 | 3/1974 | Sumiyoshi et al. | 340/52 F |
| 3,864,578 | 2/1975 | Lackey | 307/10 R |
| 3,899,770 | 8/1975 | Slotkowski | 340/52 F |
| 3,944,969 | 3/1976 | Arai et al. | 340/52 F |
| 3,946,358 | 3/1976 | Bateman | 340/27 R |
| 3,949,356 | 4/1976 | Fuzzell et al. | 340/52 F |
| 3,949,358 | 4/1976 | Higashi | 340/52 F |

*Primary Examiner*—Alvin H. Waring

*Attorney, Agent, or Firm*—Polster, Polster and Lucchesi

[57] ABSTRACT

A warning system for automotive vehicles of a construction, wherein a plurality of abnormality detectors are disposed at various locations in the vehicle so that any possible abnormality to occur may be detected, a plurality of abnormality indicators are connected to the abnormality detectors so as to be instantaneously actuated as soon as detection signals are received from the abnormality detectors and to thereby indicate abnormal situation taking place at any part of the vehicle; a plurality of action indicators are connected to the abnormality indicators to warn the driver of the action to be taken depending on the degree of the abnormal situation, and a preferential circuit is disposed in a connecting circuit between the abnormality detectors and the plurality of action indicators so as to preferentially introduce a detection signal of the highest emergency into the action indicator corresponding to such detection signal.

7 Claims, 3 Drawing Figures

WARNING SYSTEM FOR VEHICLES

BACKGROUND OF THE INVENTION

This invention relates to a warning system for vehicles, and, more particularly, it is concerned with a system to be installed in automobiles and other similar type of vehicles to give warning to the driver or operator about abnormality taken place in some part of the vehicle.

As is well realized, automobiles and other vehicles are constructed with various component parts having different functions and operations, and there has so far been no way of preventing these various component parts from bringing about abnormal conditions depending on various circumstances surrounding them. It has therefore been attempted and desired that the causes for such abnormality should be reduced to the minimum possible extent by day-to-day checking, on-the-spot repair, and various other maintenance activities.

In spite of such constant vigilance and allout efforts to prevent such troubles, however, it is usually very difficult to accomplish perfect safety measures, because these occurrences of abnormalities due to extraneous causes such as fatigue or wear and tear in each component part of vehicle, road conditions, weather conditions, inadvertence of the driver who performs such checking and maintenance are difficult to be found out.

SUMMARY OF THE INVENTION

In view of such situations which have so far been predominant, the present invention proposes to arrange abnormality detecting elements at the most necessitated places in the vehicle body, each element of which is connected to a group of indicator lamps which are actuated upon occurrence of the abnormality at a specific part of the vehicle to thereby notify the nature of the abnormality, and another group of indicator lamps which are actuated to advise the driver or operator about what measures he should take against the abnormal situation taken place. Thus, by the actuated indicator lamps, perfect safety measures can be taken in advance of the serious trouble to occur during the driving.

For instance, when the parking brake is released with the door remaining open or without fastening the safety seat belt, or when pneumatic pressure in tires is reduced, or when other causes for troubles have taken place, such situations are instantaneously indicated by corresponding indicator lamps to tell the driver of the nature of such abnormalities. Also, the actions to be taken by the driver such as "STOP", "SLOW DOWN", and so on are indicated by the action indicator lamps.

It is therefore an object of the present invention to provide a warning system for vehicles capable of advising a driver of the nature of the trouble taken place and the measures to be taken by him to rectify such abnormal situation, which comprises a plurality of abnormal place detecting elements disposed at various places in the vehicle to be taken care of, a group of abnormality (or trouble) indicator lamps which are instantaneously actuated with a signal sent from any of the abnormal place detecting elements, and thereby indicate to the driver the troubled portion in the vehicle body, and another group of action indicator lamps which indicate to the driver the measures to be taken by him in accordance with degree of danger or emergency in the particular abnormal situation.

It is another object of the present invention to provide a warning system for vehicles, in which a preferential circuit is interposed in the connecting circuit between the group of abnormal place detecting elements and the group of action indicator lamps, by the preferential circuit of which a signal of the highest degree of danger out of a plurality of signals produced from the abnormal place detecting elements is preferentially introduced into the action indicator lamp corresponding thereto.

It is still another object of the present invention to provide a warning system for vehicles, wherein a warning sound (or alarm) generating circuit provided with both oscillator and alarm device is connected to the action indicator lamp so as to generate warning sound (or alarm) simultaneously with actuation of the indicator lamp.

It is further object of the present invention to provide a warning system for vehicles, wherein the warning sound (or alarm) generating circuit provided with a plurality of oscillators, each having a different oscillating frequency and at least one alarm device, is connected to the action indicator lamp circuit so as to generate different warning sound (or alarm) in accordance with degree of danger in the abnormal situation taken place.

It is still further object of the present invention to provide a warning system for vehicles, wherein a cancellation circuit to cancel a signal to be sent to the alarm device is connected to the warning sound or alarm generating circuit so as to optionally stop the warning sound.

It is other object of the present invention to provide a warning system for vehicles, wherein the group of abnormality indicator lamps and the group of action indicator lamps are connected to the abnormal place detection signal circuit through "OR" circuits, in addition to which a checking circuit is provided in each "OR" circuit so as to verify actuation of the entire groups of indicator lamps prior to running of the vehicle with the signal sent from the abnormal place detecting elements.

It is still other object of the present invention to provide a warning system for vehicles, wherein a switch to actuate by insertion of the engine starter key, and a timer are provided in the checking circuit.

It is an additional object of the present invention to provide a warning system for vehicles, wherein a hazard lamp circuit which has already been installed in the vehicle is connected to the action indicator lamp circuit so as to notify occurrence of abnormal situation of the vehicle to pedestrians, drivers of other vehicles, and so on.

It is still an additional object of the present invention to provide a warning system for vehicles, wherein the action indicator lamps are provided in the vicinity of a speedometer on the instrument panel of the front dash board of the vehicle.

The foregoing objects and various other objects of the present invention as well as the detailed construction and operations of the warning system for vehicles according to the present invention will become more apparent from the following detailed description thereof, when read in connection with the accompanying drawing.

DETAILED DESCRIPTION OF PREFERRED EMBODIMENT

Figure 1:
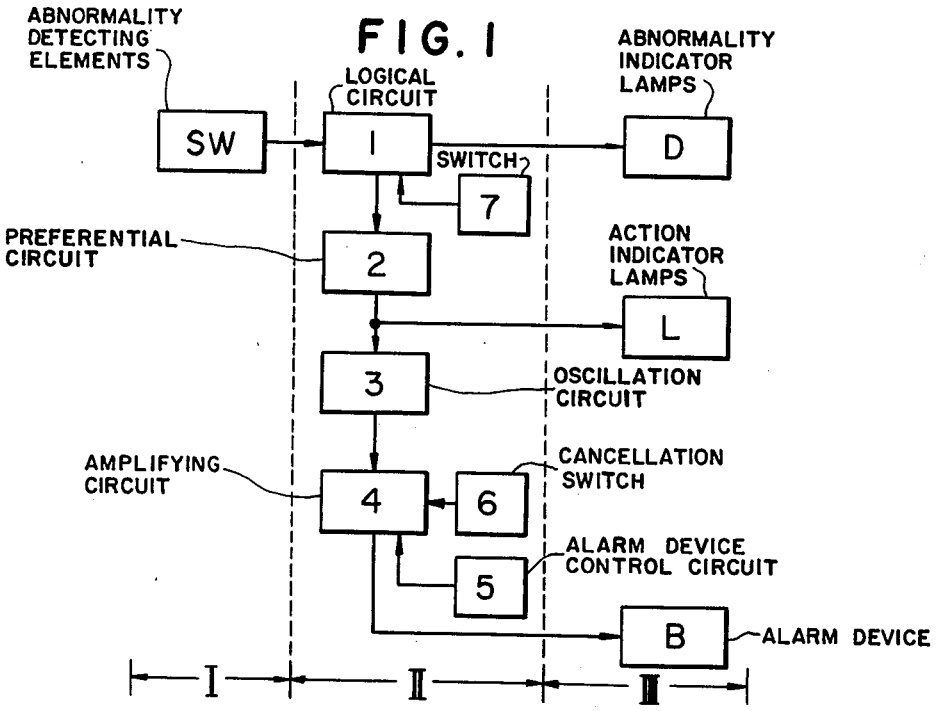
FIG. 1 is a block diagram showing an outline of the warning system according to the present invention.

Referring to FIG. 1, which is a block diagram showing an outline of the warning system according to the present invention, the system consists essentially of three sections I, II, and III.

The first section I is for detecting abnormality in the vehicle, and includes a group of abnormality detecting elements SW. The second section II is for controlling the entire warning system, and comprises a logical circuit 1 to logically treat a signal from the group of abnormality detecting elements SW, a preferential circuit 2, an oscillation circuit 3, and an amplifying circuit 4. The third section III is for indicating the abnormality taken place, and includes a group of abnormality indicator lamps D to indicate the place where the abnormality has occurred, a group of action indicator lamps L to indicate to the driver what kind of action he should take against the abnormal situation taken place, and an alarm device B.

Figure 2:
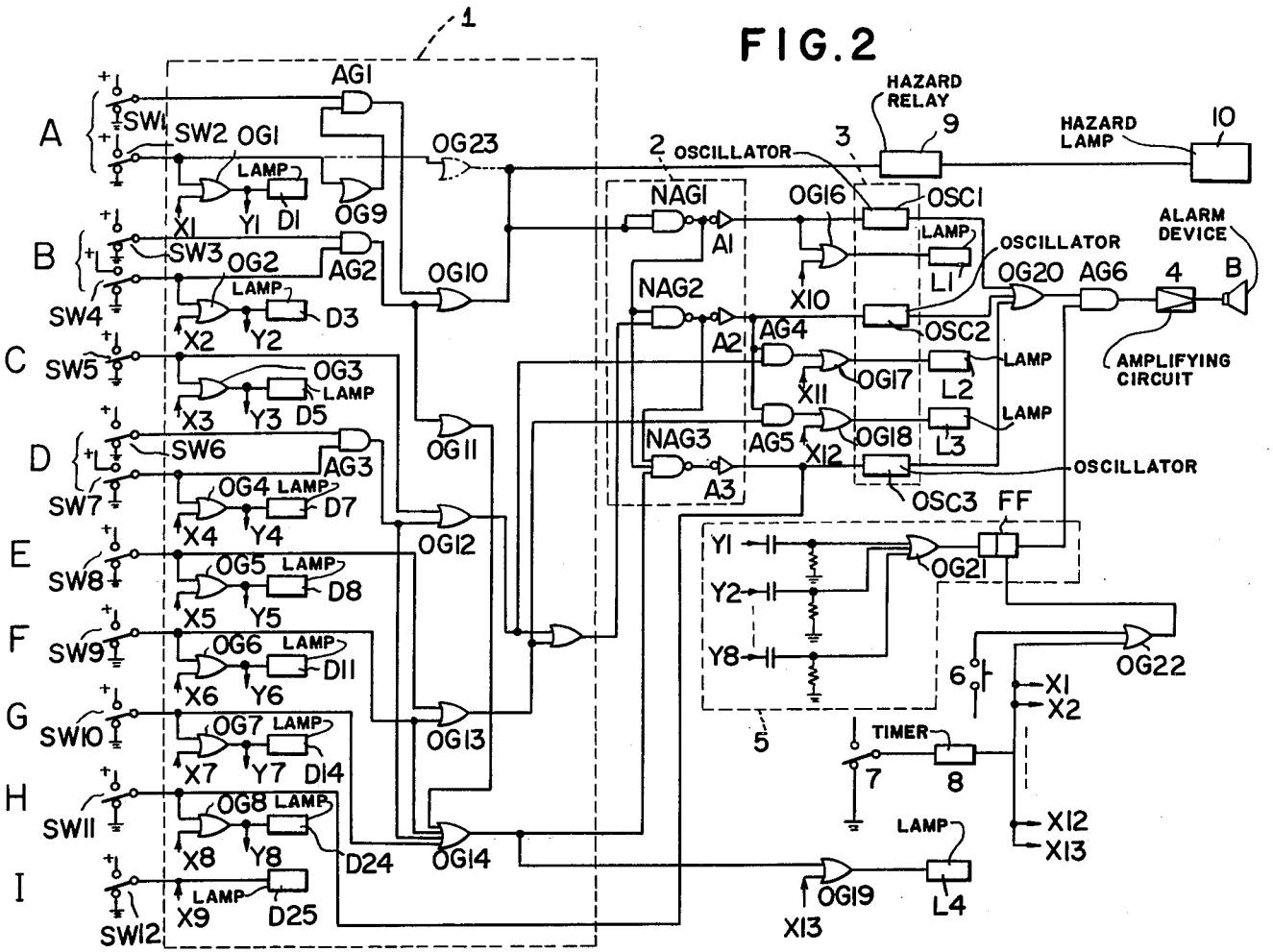
FIG. 2 is a detailed circuit diagram of one embodiment of the system according to the present invention.

FIG. 2 is a circuit diagram showing one embodiment of the warning system according to the present invention which includes abnormality detecting elements $SW_1$ to $SW_{12}$ respectively disposed at various parts of the vehicle to be taken care of. They constitute a group of the abnormality detecting elements SW shown in FIG. 1 above. For the abnormality detecting element, there may be used any type which is suited for the place to be installed such as, for example, mechanical switch, semiconductor element, and so on. The drawing figure shows the mechanical switch used.

Connected with the respective abnormality detecting elements are "OR" gates $OG_1$ $OG_{15}$ and "AND" gates $AG_1$ to $AG_3$, all of which constitute the logical circuit. "OR" gates $OG_{16}$ to $OG_{19}$ and "AND" gates $AG_4$ and $AG_5$ are to logically treat an output from the preferential circuit 2. "OR" gate $OG_{20}$ is to logically treat outputs from the oscillation circuits $OSC_1$ to $OSC_3$. "AND" gate $AG_6$ is to logically treat an output of "OR" gate $OG_{20}$ and an output from a flip-flop circuit FF. Designated by $NAG_1$ to $NAG_3$ are "NAND" gates, and the preferential circuit 2 is so constructed that an output from $NAG_1$ may be fed back to inputs of $NAG_2$ and $NAG_3$, and an output of $NAG_2$ be fed back to an input of $NAG_3$. $A_1$ to $A_3$ designate amplifiers.

The oscillators $OSC_1$ to $OSC_3$ are disposed at the output path of the amplifiers $A_1$ to $A_3$, respectively, the oscillation frequencies of which are set at 120 Hz, 80 Hz, and 40 Hz, respectively, so that warning sound or alarm of the alarm device may be different depending on the degree of emergency or danger of the abnormal situation taken place.

Reference symbols $D_1$ through $D_{30}$ designate a group of abnormality indicator lamps, each having different luminance depending on the degree of danger or emergency of the abnormal situation to be indicated. They are classified into groups A to I as shown in a table for warning indication pattern, as will appear hereinafter. The indicator lamps in each groups, for example, the indicator lamps $D_1$ and $D_2$ of the Group A, have the same electrical operations, so that only the first indicator lamps in each of the groups, i.e., $D_1$ for the group A, $D_3$ for the group B, $D_5$ for the group C, $D_7$ for the group D, $D_8$ for the group E, $D_{11}$ for the group F, $D_{14}$ for the group G, $D_{24}$ for the group H, and $D_{25}$ for the group I, are shown as a representative. Of these indicator lamps, $D_1$ to $D_{24}$ are connected to the output path of the "OR" gates $OG_1$ to $OG_8$, respectively, which, in turn, are connected to the abnormality detecting elements, and the indicator lamp $D_{25}$ is directly connected with the abnormality detecting element $SW_{12}$.

The action indicator lamps $L_1$ to $L_4$ are provided at the output path of the "OR" gates $OG_{17}$ to $OG_{20}$, respectively, and indicates to the driver of the vehicle what kind of action he should take depending on the degree of emergency of the abnormality by color, character, symbol, etc.. In the illustrated example, $L_1$ is for "STOP", $L_2$ is for "SLOW DOWN", $L_3$ is for "YIELD", and $L_4$ is for "MAINTENANCE".

A portion 5 enclosed by a dotted line is a control circuit for the alarm device B composed of "OR" gates $OG_{21}$, flip-flop FF, and so forth, the input terminals $Y_1$ to $Y_8$ of which are respectively connected to the output terminals $Y_1$ and $Y_8$ of the "OR" gates $OG_1$ to $OG_8$.

The logical circuit 1 causes the abnormality indicator lamps $D_1$, $D_3$, $D_5$, $D_7$, $D_8$, $D_{11}$, $D_{14}$, $D_{24}$, and $D_{25}$ to be actuated by the operation of the abnormality detecting elements $SW_1$ to $SW_{12}$, and also logically treats the output signals from the abnormality detecting elements to cause the action indicator lamps $L_1$ to $L_4$ to be actuated, simultaneously controlling the operation of the alarm device B.

TABLE

| | | (ALARM INDICATION PATTERN) | | | | |
|---|---|---|---|---|---|---|
| | | | ABNORMALITY INDICATOR LAMP | | ACTION INDICATOR LAMP | |
| GROUP | CONDITION FOR WARNING | ABNORMAL PLACE | No. | Color | No. | BUZZAR TONE |
| A | parking brake being released | 1 door | $D_1$ | red | $L_1$ | 120 Hz |
| | parking brake being released | 1 seat belt | $D_2$ | " | " | " |
| B | vehicle speed below 60km/hr; air pressure blw 1.0 kg/cm$^2$ | tire | $D_3$ | " | $L_1$ & $L_4$ | " |
| | air pressure blw 0.3 kg/cm$^2$ | engine oil pressure | $D_4$ | " | " | " |
| C | vehicle speed above 100 km/hr. | speed | $D_5$ | orange | $L_2$ | 80 Hz |
| | vehicle body side G above 0.25G | side sliding | $D_6$ | " | " | " |

TABLE-continued

| GROUP | CONDITION FOR WARNING | (ALARM INDICATION PATTERN) ABNORMAL PLACE | ABNORMALITY INDICATOR LAMP No. | ABNORMALITY INDICATOR LAMP Color | ACTION INDICATOR LAMP No. | BUZZAR TONE |
|---|---|---|---|---|---|---|
| D | vehicle speed above 60 km/hr. | | | | | |
| | air pressure blw 1.2 kg/cm$^2$ | tire | $D_7$ | " | $L_2$ & $L_4$ | " |
| E | choke being closed, water temp. below | brake heated | $D_8$ | yellow | $L_3$ | " |
| | 60° C, behicle speed above 10 km/hr, parking brake being applied | choke | $D_9$ | " | " | " |
| | | | $D_{10}$ | " | " | " |
| F | water temp. abv 120° C | overheat | $D_{11}$ | " | $L_3$ & $L_4$ | " |
| | steering oil pressure blw 0.5 kg/cm$^2$ | steering oil pressure | $D_{12}$ | " | " | " |
| | oil pressure difference between two systems abv 0.5 kg/cm$^2$ | brake oil pressure | $D_{13}$ | " | " | " |
| G | battery charging function NG, charging qty insufficient | charge | $D_{14}$ | " | $L_4$ | 40 Hz |
| | various lamps disconnected or poor contact | lamp | $D_{15}$ | " | " | " |
| | effective residual thickness of pad blw 2 mm | pad worn out | $D_{16}$ | " | " | " |
| | residual fuel qty blw 5 ltr | gasoline | $D_{17}$ | " | " | " |
| | residual qty of engine oil below 2 ltr | engine oil | $D_{18}$ | " | " | " |
| | residual qty of brake oil below ⅔ | brake oil | $D_{19}$ | " | " | " |
| | residual reserve qty of water blw 0.3 ltr. | radiator | $D_{20}$ | " | " | " |
| | battery lquid below lower level | battery liquid | $D_{21}$ | " | " | " |
| | residual qty of washer liquid below 0.3 ltr. | washer liquid | $D_{22}$ | " | " | " |
| | at least one fuse wire broken or poor contact | fuse box | $D_{23}$ | " | " | " |
| H | key left inside cabin, lighting switch on at door opening | light on | $D_{24}$ | " | " | " |
| I | atmospheric temp. blw 2° C | freezing of water, etc. | $D_{25}$ | " | — | — |
| | parking brake being applied | door | $D_{26}$ | red | — | — |
| | parking brake being applied | seat belt | $D_{27}$ | " | — | — |
| | monitor | turn signal | $D_{28}$ | green | — | — |
| | monitor | high beam | $D_{29}$ | blue | — | — |
| | monitor | parking brake | $D_{30}$ | red | — | — |

In the following, the above-tabulated warning indication pattern will be explained in detail with reference to FIG. 2.

(A) A case wherein the parking brake is to be released, when the door is left open. In this case, the abnormality detecting elements $SW_1$ and $SW_2$ are turned to the (+) side to cause the abnormality indicator lamp $D_1$ to be lit through the circuit connection of $SW_2$-$OG_1$-$D_1$, whereby the driver is warned against the door which is left open. At the same time, through the circuit connection of $$\left.\begin{matrix} SW_1\text{-}OG_9 \\ SW_2 \end{matrix}\right\}\text{-}AG_1\text{-}OG_{10}\text{-}NAG_1\text{-}A_1\text{-}\left\{\begin{matrix} OG_{16}\text{-}L_1 \\ OSC_1\text{-}OG_{20} \end{matrix}\right\}\text{-}AG_6\text{-}4\text{-}B,$$

the action indicator lamp $L_1$ is lit to warn the driver to "STOP". Simultaneously, an alarm sound having an oscillation frequency of 120 Hz is generated from the alarm device B.

(B) A case, wherein the vehicle speed is 60 km/hr. and below, or the pneumatic pressure in tires is 1.0 kg/cm$^2$ and below. In this case, abnormality detecting elements $SW_3$ and $SW_4$ are turned to the (+) side to cause the abnormality indicator lamp $D_3$ to be actuated through the circuit connection of $SW_4$-$OG_2$-$D_3$ and indicate to the driver that the air pressure in the tires has lowered. At the same time, through the circuit connection of $$\left.\begin{matrix}SW_3\\SW_4\end{matrix}\right\}\text{-}AG_2\text{-}\left\{\begin{matrix}OG_{10}\text{-}NAG_1\text{-}A_1\text{-}\left\{\begin{matrix}OG_{16}\text{-}L_1\\OSC_1\text{-}OG_{20}\\3\end{matrix}\right\}\text{-}AG_6\text{-}4\text{-}B,\\OG_{14}\text{-}OG_{19}\text{-}L_4\end{matrix}\right.$$

the warning indication of same frequency as the above mode (A) and the "MAINTENANCE" indication as well are performed with the action indicator lamp $L_4$.

(C) A case, wherein the vehicle speed is higher than 100 km/hr.. In this case, the abnormality detecting element $SW_5$ is turned to the (+) side to cause the abnormality indicator lamp $D_5$ to be actuated through the circuit connection of $SW_5$-$OG_3$-$D_5$, whereby the driver is warned against the overspeed of the vehicle. At the same time, through the circuit connection of $$\left.\begin{matrix}SW_5\text{-}OG_{12}\text{-}OG_{15}\text{-}NAG_2\text{-}A_2\\OG_{12}\end{matrix}\right\}\begin{matrix}\text{-}OSC_2\text{-}OG_{20}\\5\end{matrix}\Big\}\text{-}AG_6\text{-}4\text{-}B,\ \text{-}AG_4\text{-}OG_{17}\text{-}L_2$$

the action indicator lamp $L_2$ is caused to light on to direct the driver to effect "SLOW DOWN" in the vehicle running speed, in accompaniment with generation of alarm (warning sound) having an oscillation frequency of 80 Hz from the alarm device B.

(D) A case, wherein the vehicle speed is higher than 60 km/hr., or the air pressure in the tire is 1.2 kg/cm$^2$ or below. In this case, the abnormality detecting elements $SW_6$ and $SW_7$ are turned to the (+) side to cause the abnormality indicator lamps $D_7$ to be lit through the circuit connection of $SW_7$-$OG_4$-$D_7$, whereby the driver is warned against the reduced air pressure in the tires. At the same time, through the circuit connection of:

$$\left.\begin{matrix}SW_6\\SW_7\end{matrix}\right\}\text{-}AG_3\left\{\begin{matrix}OG_{14}\text{-}OG_{19}\text{-}L_4\\OG_{12}\text{-}OG_{15}\text{-}NAG_2\text{-}A_2\\OG_{12}\end{matrix}\right.\begin{matrix}\text{-}OSC_2\text{-}OG_{20}\\5\end{matrix}\Big\}\text{-}AG_6\text{-}4\text{-}B,\ \text{-}AG_4\text{-}OG_{17}\text{-}L_2$$

the action indicator lamps $L_2$ and $L_4$ are caused to light on to instruct the driver to effect "SLOW DOWN" in the vehicle speed and "MAINTENANCE" of the vehicle, in accompaniment with generation of alarm having an oscillating frequency of 80 Hz from the alarm device B.

(E) A case, wherein the brake has become overheated. In this case, the abnormality indicating element $SW_8$ is turned to the (+) side to cause the abnormality indicator lamp $D_8$ to light on through the circuit connection of $SW_8$-$OG_5$-$D_8$, whereby the driver is warned against the over-heating in the brake. At the same time, through the circuit connection of $SW_8$-$OG_{13}$-$OG_{15}$-

$$\left.\begin{matrix}NAG_2\text{-}A_2\text{-}\\OG_{13}\end{matrix}\right\}\text{-}AG_5\text{-}OG_{18}\text{-}L_3\ \left\{\begin{matrix}OSC_2\text{-}OG_{20}\\5\end{matrix}\right\}\text{-}AG_6\text{-}4\text{-}B,$$

the action indicator lamp $L_3$ is caused to light on to instruct the driver to observe "YIELD", in accompaniment with generation of alarm having the same oscillating frequency as above mode (D).

(F) A case, wherein the water temperature is higher than 120° C. In this case, the abnormality detecting element $SW_9$ is turned to the (+) side to cause the abnormality indicator lamp $D_{11}$ to light on through the circuit connection of $SW_9$-$OG_6$-$D_{11}$, whereby the driver is warned against over-heating of water. At the same time, through the circuit connection of:

$$SW_9\text{-}\left\{\begin{matrix}OG_{13}\text{-}OG_{15}\text{-}NAG_2\text{-}\\OG_{13}\\OG_{14}\text{-}OG_{19}\text{-}L_4\end{matrix}\right\}\text{-}AG_5\text{-}OG_{18}\text{-}L_3\ \left\{\begin{matrix}OSC_2\text{-}OG_{20}\\5\end{matrix}\right\}\text{-}AG_6\text{-}4\text{-}B,$$

the action indicator lamps $L_3$ and $L_4$ are lit on to instruct the driver to perform "YIELD" and "MAINTENANCE", in accompaniment with alarm sound of an oscillation frequency of 80 Hz by the alarm device B.

(G) A case, wherein the battery charging function and the charging quantity are insufficient. In this case, the abnormality detecting element $SW_{10}$ is turned to the (+) side to cause the abnormality indicator lamp $D_{14}$ to light on through the circuit connection of $SW_{10}$-$OG_7$-$D_{14}$, whereby the driver is warned against necessity for battery charging. At the same time, through the circuit connection of:

$$SW_{10}\text{-}OG_{14}\text{-}\left\{\begin{matrix}NAG_3\text{-}A_3\text{-}OSC_3\text{-}OG_{20}\\5\\OG_{19}\text{-}L_4\end{matrix}\right\}\text{-}AG_6\text{-}4\text{-}B,$$

the action indicator lamp $L_4$ is caused to light on to instruct the driver to perform "MAINTENANCE" of the vehicle in accompaniment with generation of alarm sound having an oscillating frequency of 40 Hz by the alarm device.

(H) A case, wherein lighting is forgotten to be extinguished, or the door is opened with the engine starter key being left in the vehicle. In this case, the abnormality detecting element $SW_{11}$ is turned to the (+) side to cause the abnormality indicator lamp $D_{24}$ to light on through the circuit connection of $SW_{11}$-$OG_{18}$-$D_{24}$, whereby the driver is warned against his forgetfulness of extinguishing the lighting. At the same time, through the circuit connection of $$SW_{11}\text{-}OSC_3\text{-}OG_{20}\ \left\}\begin{matrix}\\5\end{matrix}\right\}\text{-}AG_6\text{-}4\text{-}B,$$

alarm sound of an oscillation frequency of 40 Hz is generated by the alarm device B.

(I) A case, wherein temperature of the surrounding atmosphere is 2° C or below. In this case, the abnormality detecting element $SW_{12}$ is turned to the (+) side to cause the abnormality indicator lamp $D_{25}$ to light on through the circuit connection of $SW_{12}$-$D_{25}$, whereby the driver is warned against freezing of water.

While the logical circuit 1 of the apparatus according to the present invention as shown in the drawing can only perform the detection and indication of any one of the abnormalities as listed in the classifications A through I in the above-presented warning indication pattern table, it will become possible to detect and indicate all the warning patterns in the table and other abnormalities by establishing a required logic with increased number of the abnormality detecting elements and various logical gates.

In the above example, the abnormality indicator lamp and the action indicator lamp continue to light on until the abnormality generated is rectified.

When the abnormal situations A and B in the above-mentioned classification are simultaneously taken place, the respective abnormal situations generated are indicated by the abnormality indicator lamps $D_1$ and $D_3$, while the instructions to the driver for action to take are represented by the action indicator lamp $L_1$ for the abnormality of the highest degree of danger occurred, i.e., the car "STOP" alone, in accompaniment with an alarm sound having an oscillation frequency of 120 Hz from the alarm device. In other words, since the preferential circuit 2 logically negates (non-establishes) the "NAND" gate $NAG_2$ with an output from the "NAND" gate $NAG_1$, the action indicator lamp $L_2$ and the oscillator $OSC_2$ do not operate, whereby no instructions for the abnormal situation in the group B is performed, and the measures to be taken are notified to the driver only for the abnormal situation of higher degree of danger or emergency so that the preventive measures against possible accident may be taken promptly without failure.

In view of the fact that the warning sound, or alarm, causes noise pollution when it is continuously produced for a long period of time, it is desirable that the alarm be stopped freely as soon as the driver has verified the abnormality occurred. For this purpose, the present invention proposes to provide a manually operable cancellation switch 6 in the reset circuit of the flip-flop FF in the alarm device control circuit 5 (in the vicinity of the driver's seat). By arbitrarily closing this cancellation switch 6 to cause the same to reset to the flip-flop FF and to render the "AND" gate $AG_6$ to be in a state of a logical non-establishment, the alarm device B can be stopped. It is also possible that the flip-flop FF is substituted for a timer to cause the alarm device B to be actuated for a certain definite length of time alone. In this case, no cancellation switch 6 is necessary.

Whenever any one of the abnormality indicator lamps $D_1$, $D_3$, $D_5$, $D_7$, $D_8$, $D_{11}$, $D_{14}$, $D_{24}$, $D_{25}$, and the action indicator lamps $L_1$ to $L_4$ is disconnected, accurate indication of abnormality becomes impossible. In order to avoid such defect, total checking of the indicator lamps should preferably be performed at the start of the engine. As an expedient to effect this total lamp checking, the illustrated example is designed in such a manner that a total lamp checking circuit consisting of a switch 7 which is closed by insertion of an engine starter key, and a timer 8 is provided, and the output terminals $X_1$ to $X_{12}$ of the timer are connected to the input terminals $X_1$ to $X_{12}$ of the "OR" gate $OG_1$ to $OG_8$, and $OG_{16}$ to $OG_{19}$ so as to cause the entire indicator lamps $D_1$, $D_3$, $D_5$, $D_7$, $D_8$, $D_{11}$, $D_{14}$, $D_{24}$, $D_{25}$, and $L_1$ to $L_4$ to light on for a certain period of time to be determined by the timer 8, e.g., 5 to 8 seconds. For the timer 8, there can be used a Schmidt circuit having a CR time constant circuit at the input side, wherein charging of a capacitor is commenced by insertion of the engine starter key, and the time required for the charge voltage to reach a predetermined level is made the operating time of the timer. After the charge voltage has arrived at the predetermined level and until the engine starter key is pulled out, the timer is maintained in its non-operative state by the voltage charged in the capacitor. In this case, as the output from the timer is input into the reset of the flip-flop FF through the "OR" gate $OG_{22}$, the "AND" gate $AG_6$ is logically non-established, so that, even when a signal will be applied to the other input terminal of the "AND" gate for some reason or others, the alarm device B does not operate at the time of the total lamp checking.

When an abnormal situation of high degree of emergency takes place, it is highly desirable for the secondary accident to be prevented that not only the driver is warned against this abnormal situation through the abnormality indicator lamp, but also any other third persons who will possibly be involved in this abnormal situation such as, for example, pedestrians, drivers of other vehicles, and so on be notified of such situation. For this purpose, the system according to the present invention proposes to inform these third persons of the abnormal situation by utilizing a signal for a particularly high degree of danger which is to be input into the action indication $L_1$ to cause a hazard relay 9 equipped in the vehicle to actuate so that the relay may in turn cause a hazard lamp 10 to flash. In this case, it is also possible to construct the circuitry in such a way that, as shown by a chain line, an independent signal is taken out of each abnormality detecting element and the thus taken-out signal is input into the hazard relay 9 through the "OR" gate $OG_{23}$.

Figure 3:
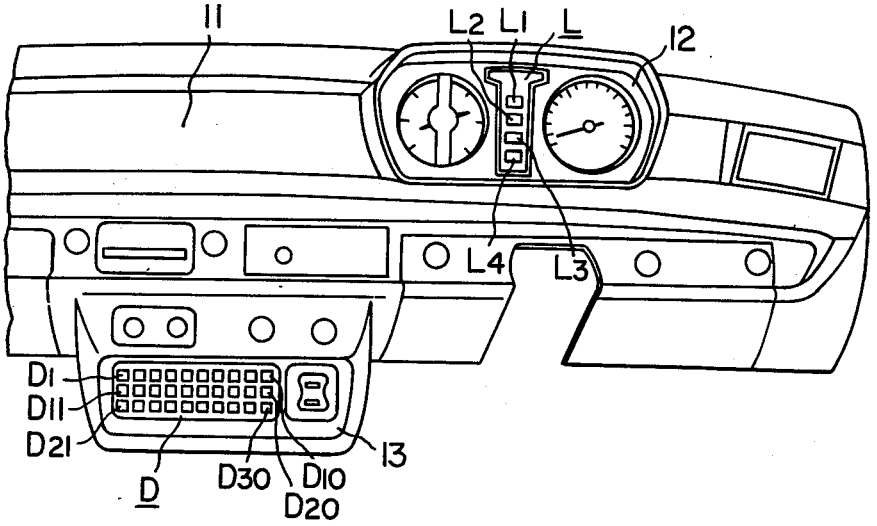
FIG. 3 is a front view of an instrument panel of a vehicle, in which the groups of indicator lamps are accommodated.

It is desirable that the action indicator lamps $L_1$ to $L_4$ be able to quickly and accurately give instructions to the driver as to the content of the action to be taken by him. In order to attain this objective, the present invention, as shown in FIG. 3, provides such action indicator lamps in the vicinity of the speedometer 12 on the instrument panel 11 at the front part of the vehicle, which is disposed at a position where the meter observation can be done most easily, whereby the desired purpose can be sufficiently achieved. Further, the position where the abnormality indicator lamps $D_1$ through $D_{30}$ are to be disposed may be at any arbitrary place in one part of the vehicle such as, for example, ceiling, inner door, and others. In the illustrated example, they are disposed in a pocket recess or alcove 13 of the instrument panel.

As stated in the foregoing, the warning system for motor vehicles according to the present invention is constructed in such a manner that, by providing both abnormality indicator lamps and action indicator lamps, the driver may be notified of abnormality taken place at a particular place in the vehicle, and, at the same time, of the most appropriate action to be taken by him against this abnormal situation occurred, so that the driver can take prompt and adequate action to meet the particular situation. Moreover, as the action to be taken by the vehicle driver can also be represented by alarm sound having differing oscillation frequency depending on a particular indicator lamp for abnormality of differing degree of emergency, the abnormal situation taken place can be easily recognized without failure.

Although the invention has been described with reference to a particular embodiment of the warning system, it is to be noted that the embodiment is merely illustrative and not so restrictive, and that any change and modification in its construction may be made by those skilled in the art in the circuit construction and wiring connections to meet various purposes of the warning system without departing from the spirit and scope of the invention as set forth in the appended claims.

What is claimed is:

1. A warning system for vehicles which comprises in combination:

(a) a plurality of abnormality detecting means disposed at various parts of the vehicle to be inspected;

(b) a plurality of abnormality indicator means to be actuated instantaneously upon receipt of a detection signal from said abnormality detecting means to thereby indicate abnormality which has taken place at any part of the vehicle;

(c) a plurality of action indicator means to notify a vehicle driver of the action to be taken depending on the degree of danger or emergency in the abnormal situation taken place; and (d) a preferential circuit provided in a connecting circuit between said plurality of abnormality detecting means and said plurality of action indicator means, and to introduce preferentially a detection signal having the highest degree of emergency out of a plurality of detection signals from said abnormality detecting means into said action indicator means corresponding to such detection signal.

2. The warning system for vehicles as claimed in claim 1, wherein an alarm sound generating circuit having an oscillator and an alarm device is connected to said action indicator means circuit to produce alarm sound simultaneously with actuation of said action indicator means; and a cancellation circuit to cancel a signal to be introduced into said alarm device is connected to said alarm sound generating circuit to arbitrarily stop the alarm sound.

3. The warning system for vehicles as claimed in claim 1, wherein an alarm sound generating circuit comprising a plurality of oscillators, each having different oscillation frequency, and at least one alarm device is connected to said action indicator means circuit to produce alarm sound of different oscillating frequency in accordance with degree of danger or emergency in abnormal situation which has taken place; and a cancellation circuit to cancel a signal to be introduced into the alarm device is connected to said alarm sound generating circuit to arbitrarily stop the alarm sound.

4. The warning system for vehicles as claimed in claim 1, wherein said plurality of abnormality indicator means and said plurality of action indicator means are connected to said abnormality detecting means through "OR" gate circuit, and a checking circuit having a switch means actuable by insertion of an engine starter key is provided to send a signal to each "OR" gate circuit and to verify actuation of said plurality of respective indicator means prior to running of the vehicle.

5. The warning system for vehicles as claimed in claim 4, wherein a timer to control a time period of lightening in said plurality of abnormality indicator means and said plurality of action indicator means is provided in said switch means.

6. The warning system for vehicles as claimed in claim 1, wherein a hazard lamp circuit already provided in the vehicle is connected with said plurality of action indicator means to notify pedestrians, drivers of other vehicles, etc. of the occurrence of the abnormal situation in the vehicle.

7. The warning system for vehicles as claimed in claim 1, wherein at least said action indicator means are disposed in the vicinity of a speedometer on the instrument panel at the front part of the vehicle cabin.

* * * * *

UNITED STATES PATENT AND TRADEMARK OFFICE

CERTIFICATE OF CORRECTION

PATENT NO. : 4,072,925

DATED : February 7, 1978

INVENTOR(S) : Michio Yashima, Takaya Senzaki and Norimitsu Kurihara

It is certified that error appears in the above-identified patent and that said Letters Patent are hereby corrected as shown below:

Under TABLE, below columns 3 and 4, in GROUP A, line 1 before "door" cancel numeral 1; line 2, before "released" cancel "being", same line, after "released" insert ---and door opened---; line 3, cancel numeral 1; line 4, cancel "being"; same line, after "released" insert ---and seat belt unfastened---.

GROUP B, line 2, after "hr" cancel the semicolon and insert ---with---; line 4, after "1.0 kg/cm$^2$" insert ---in tire---; same group, line 5, cancel "air" and insert ---oil---; line 6, after "cm$^2$" insert ---in engine---.

Under TABLE-continued, below columns 5 and 6, in GROUP D, line 2, after "hr." insert ---with---; GROUP E, before line 1 above "choke being" insert ---brake pad overheated---; line 1, after "choke" cancel "being"; line 4, after "60°C" cancel the comma and insert a period; same line, cancel "behicle" and insert ---vehicle---; line 8, cancel "being"; same group under Abnormal Place, line 7, insert ---parking brake---; GROUP F, line 10, cancel "systems" and insert ---braking circuits---.

GROUP G, line 3, cancel "NG, charging"; line 4, cancel "qty"; line 12, after "of" and before "pad" insert ---brake---; under Abnormal Place, line 10, before "pad" insert ---brake---; GROUP H, cancel lines 1 through 4 and substitute ---lighting switch "on" when engine starter key pulled out of key slot and door left open---; GROUP I, lines 1-3 under Abnormal Place, cancel "freezing of water, etc." and insert ---radiator---; same group, line 4, before "applied" cancel "being" and after "applied" insert ---and door opened---; line 5, cancel "being"; same line after "applied" insert ---and seat belt unfastened---;

UNITED STATES PATENT AND TRADEMARK OFFICE

CERTIFICATE OF CORRECTION

PATENT NO. : 4,072,925

DATED : February 7, 1978

INVENTOR(S) : Michio Yashima, Takaya Senzaki and Norimitsu Kurihara

It is certified that error appears in the above-identified patent and that said Letters Patent are hereby corrected as shown below:

line 7, after "monitor" insert ---lamp of turn signal---; line 8, after "monitor" insert ---lamp of head light---; line 9, after "monitor" insert ---lamp of parking brake---.

Signed and Sealed this

*Twenty-fourth* Day of *October 1978*

[SEAL]

*Attest:*

RUTH C. MASON
*Attesting Officer*

DONALD W. BANNER
*Commissioner of Patents and Trademarks*